US008042914B2

(12) United States Patent
Sato

(10) Patent No.: US 8,042,914 B2
(45) Date of Patent: Oct. 25, 2011

(54) JETTING ERROR DETECTOR, DROPLET JETTING APPLICATOR AND DISPLAY DEVICE MANUFACTURING METHOD

(75) Inventor: Tsuyoshi Sato, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 324 days.

(21) Appl. No.: 12/233,992

(22) Filed: Sep. 19, 2008

(65) Prior Publication Data

US 2009/0079799 A1 Mar. 26, 2009

(30) Foreign Application Priority Data

Sep. 20, 2007 (JP) ..... 2007-244148

(51) Int. Cl.
*B41J 2/045* (2006.01)
*B41J 29/393* (2006.01)

(52) U.S. Cl. ..... 347/68; 347/19

(58) Field of Classification Search ..... 347/10
See application file for complete search history.

(56) References Cited

U.S. PATENT DOCUMENTS

| | | | | |
|---|---|---|---|---|
| 7,232,199 | B2 * | 6/2007 | Shinkawa et al. | 347/19 |
| 7,690,744 | B2 * | 4/2010 | Nakanishi et al. | 347/12 |
| 2004/0223016 | A1 * | 11/2004 | Koyama | 347/12 |
| 2006/0017765 | A1 * | 1/2006 | Sato | 347/19 |

FOREIGN PATENT DOCUMENTS

| | | |
|---|---|---|
| CN | 1454149 A | 11/2003 |
| CN | 1608006 A | 4/2005 |
| JP | 4-29851 | 1/1992 |
| JP | 11-334102 | 12/1999 |

* cited by examiner

*Primary Examiner* — Matthew Luu

*Assistant Examiner* — Lisa Solomon

(74) *Attorney, Agent, or Firm* — Oblon, Spivak, McClelland, Maier & Neustadt, L.L.P.

(57) ABSTRACT

A jetting error detector includes multiple input circuits configured to receive respective voltage values of multiple piezoelectric elements from a droplet jetting head configured to jet droplets through multiple nozzles by use of the multiple piezoelectric elements, a selection circuit configured to sequentially select one of the multiple input circuits, a judging unit configured to judge, based on the voltage value inputted to the selected input circuit, jetting quality of the nozzle for jetting the droplets by use of the piezoelectric element corresponding to the selected input circuit, and an output circuit configured to output a jetting quality judgment result of the nozzle.

9 Claims, 4 Drawing Sheets

JETTING ERROR DETECTOR, DROPLET JETTING APPLICATOR AND DISPLAY DEVICE MANUFACTURING METHOD

CROSS REFERENCE OF THE RELATED APPLICATION

This application is based on and claims the benefit of priority from Japanese Patent Application No. 2007-244148, filed on Sep. 20, 2007; the entire contents of which are incorporated herein by reference.

BACKGROUND OF THE INVENTION

1. Field of the Invention

The present invention relates to a jetting error detector, a droplet jetting applicator, and a display device manufacturing method. More specifically, the present invention relates to a jetting error detector configured to detect a jetting error of a droplet jetting head for jetting droplets, a droplet jetting applicator including the jetting error detector, and a display device manufacturing method using the droplet jetting applicator.

2. Description of the Related Art

A droplet jetting applicator is typically used for manufacturing various display devices such as a liquid crystal display device, an organic EL (electro-luminescence) display device, an electron emission display device, a plasma display device and an electrophoretic display device. This droplet jetting applicator includes a droplet jetting head for jetting droplets from its multiple nozzles toward an application target. The droplet jetting head makes multiple droplets land on the application target, thereby forming dot arrays in a predetermined pattern so that various coated bodies (such as a color filter) are manufactured.

In such a droplet jetting applicator, whether or not a jetting failure will occur is generally checked prior to an application operation. Factors of this jetting failure include bubbles, dusts and so forth. Concerning bubble detection, there have been disclosed a technique for determining and detecting the presence of a bubble and a technique for determining whether or not a bubble adheres to a piezoelectric element (see JP-A No. 4-29851 and JP-A No. 11-334102, for example). Even if it is confirmed, prior to an application operation, that no jetting failure will occur, a jetting error such as a jetting failure or a jetting amount shortage may occur depending on the degree of contamination with bubbles, dusts and the like in the course of an application operation to perform application based on application pattern data. In particular, a jetting error may be caused by disturbance vibration, bubble growth or the like during the application operation.

However, according to the related art, it is not possible to detect the above-mentioned jetting error in the course of the application operation. Therefore, if a jetting error occurs, application defective items are continuously manufactured until the occurrence of the jetting error is found by an inspection in a different process. This leads to a decrease of production yield in the application process using the droplet jetting head.

SUMMARY OF THE INVENTION

An object of the present invention is to provide a jetting error detector, a droplet jetting applicator, and a display device manufacturing method, which are capable of preventing deterioration in production yield attributable to a jetting error.

A first aspect according to an embodiment of the present invention provides a jetting error detector which includes multiple input circuits configured to receive respective voltage values of multiple piezoelectric elements from a droplet jetting head configured to jet droplets through multiple nozzles by use of the multiple piezoelectric elements, a selection circuit configured to sequentially select one of the multiple input circuits, a judging unit configured to judge, based on the voltage value inputted to the selected input circuit, jetting quality of the nozzle for jetting the droplets by use of the piezoelectric element corresponding to the selected input circuit, and an output circuit configured to output a jetting quality judgment result of the nozzle.

A second aspect of the embodiment of the present invention provides a droplet jetting applicator which includes a droplet jetting head configured to jet droplets through multiple nozzles by use of multiple piezoelectric elements, and a jetting error detector having multiple input circuits to which respective voltage values of the multiple piezoelectric elements are inputted, a selection circuit configured to sequentially select one of the multiple input circuits, a judging unit configured to judge, based on the voltage value inputted to the selected input circuit, jetting quality of the nozzle for jetting the droplets by use of the piezoelectric element corresponding to the selected input circuit, and an output circuit configured to output a jetting quality judgment result of the nozzle.

A third aspect of the embodiment of the present invention provides a display device manufacturing method, in which droplets are jetted and applied onto an application target by using the droplet jetting applicator according to the second aspect.

DESCRIPTION OF THE PREFERRED EMBODIMENTS

An embodiment of the present invention will be described with reference to the accompanying drawings.

Figure 1:
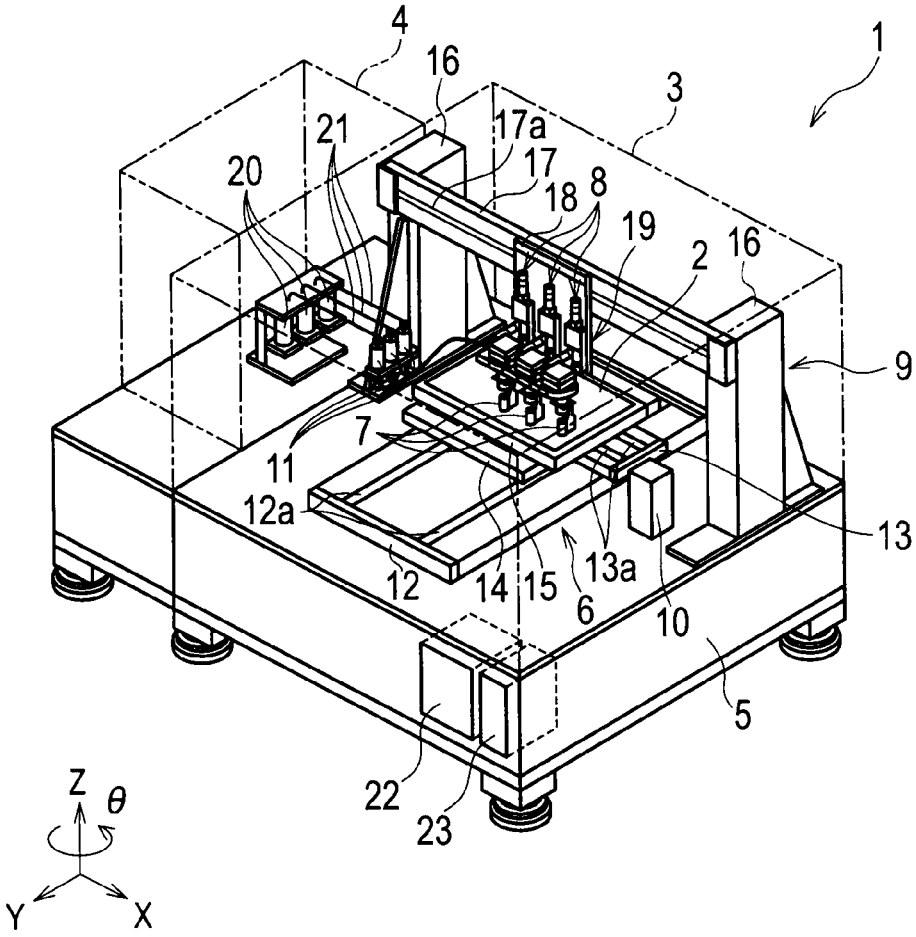
FIG. 1 is a perspective view showing a schematic configuration of a droplet jetting applicator according to an embodiment of the present invention.

As shown in FIG. 1, a droplet jetting applicator 1 according to the embodiment of the present invention includes an ink application box 3 for applying liquid ink as droplets onto a substrate 2 of an application target, and an ink supply box 4 for supplying the ink to the ink application box 3. The ink application box 3 and the ink supply box 4 are located adjacent to each other and provided on an upper surface of a pedestal 5.

Inside the ink application box 3, there are provided a substrate movement mechanism 6 for holding and moving the substrate 2 in an X-axis direction and a Y-axis direction, multiple inkjet head units 8 respectively including droplet jetting heads 7 for jetting the droplets, a unit movement mechanism 9 for moving those inkjet head units 8 integrally in the X-axis direction, a head maintenance unit 10 for cleaning the droplet jetting heads 7, and multiple ink buffer tanks 11 for containing ink.

The substrate movement mechanism 6 includes a Y-axis direction guide plate 12, a y-axis direction movement table 13, an X-axis direction movement table 14, and a substrate holding table 15. The Y-axis direction guide plate 12, the Y-axis direction movement table 13, the X-axis direction movement table 14, and the substrate holding table 15 are formed into plate shapes and stacked on the upper surface of the pedestal 5.

The Y-axis direction guide plate 12 is fixed onto the upper surface of the pedestal 5. Multiple guide grooves 12*a* are provided along the Y-axis direction on an upper surface of this Y-axis direction guide plate 12. These guide grooves 12*a* guide the Y-axis direction movement table 13 along the Y-axis direction.

The Y-axis direction movement table 13 includes multiple protrusions (not shown) formed on a lower surface and engaging with the respective guide grooves 12*a*, and is provided on the upper surface of the Y-axis direction guide plate 12 so as to be movable in the Y-axis direction. Multiple guide grooves 13*a* are provided along the X-axis direction on an upper surface of this Y-axis direction movement table 13. These guide grooves 13*a* guide the X-axis direction movement table 14 along the X-axis direction. The above-described Y-axis direction movement table 13 moves in the Y-axis direction along the guide grooves 12*a* by way of a movement mechanism (not shown) using a feed screw, a driving motor, and the like.

The X-axis direction movement table 14 includes multiple protrusions (not shown) formed on a lower surface and engaging with the respective guide grooves 13*a*, and is provided on the upper surface of the Y-axis direction movement table 13 so as to be movable in the X-axis direction. This X-axis direction movement table 14 moves in the X-axis direction along the guide grooves 13*a* by way of a movement mechanism (not shown) using a feed screw, a driving motor, and the like.

The substrate holding table 15 is fixed onto an upper surface of the X-axis direction movement table 14. This substrate holding table 15 includes an adsorption mechanism (not shown) for adsorbing the substrate 2, and fixes and thereby holds the substrate 2 onto the upper surface by using the adsorption mechanism. Here, an air adsorption mechanism is used as the adsorption mechanism, for example.

The unit movement mechanism 9 includes a pair of columns 16 vertically provided on the upper surface of the pedestal 5, an X-axis direction guide plate 17 connected between upper ends of the columns 16 and extending in the X-axis direction, and a base plate 18 provided on the X-axis direction guide plate 17 so as to be movable in the X-axis direction and configured to support the inkjet head units 8.

The pair of columns 16 are provided so as to interpose the Y-axis direction guide plate 12 therebetween in the X-axis direction. Meanwhile, a guide groove 17*a* is provided on a front face of the X-axis direction guide plate 17 along the X-axis direction. This guide groove 17*a* guides the base plate 18 in the X-axis direction. The base plate 18 includes a protrusion (not shown) formed on a lower surface and engaging with the guide grooves 17*a*, and is provided on the X-axis direction guide plate 17 so as to be movable in the X-axis direction. This base plate 18 moves in the X-axis direction along the guide groove 17*a* by way of a movement mechanism (not shown) using a feed screw, a driving motor, and the like. Three inkjet head units 8 are fitted to a front surface of the base plate 18.

Each of the inkjet head units 8 includes a droplet jetting head 7 for jetting multiple droplets and a supporting mechanism 19 provided on the base plate 18 and configured to movably support the droplet jetting head 7.

Figure 2:
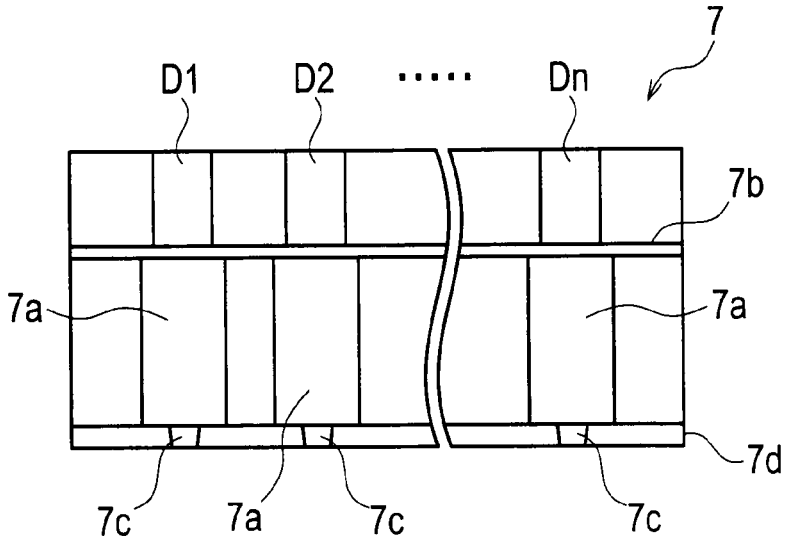
FIG. 2 is a schematic diagram showing a schematic configuration of a droplet jetting head included in the droplet jetting applicator shown in FIG. 1.

As shown in FIG. 2, the droplet jetting head 7 includes multiple ink chambers 7*a* for containing the ink supplied from ink buffer tanks 11, a diaphragm 7*b* for forming part of walls of the ink chambers 7*a*, multiple piezoelectric elements (actuators) D1 to Dn (n: a positive integer) provided so as to respectively correspond to the ink chambers 7*a*, and a nozzle plate 7*d* having multiple nozzles (through holes) 7*c* that communicate with the respective ink chambers 7*a* and forming part of walls of the ink chambers 7*a*.

The nozzles 7*c* are formed in series at a constant pitch on the nozzle plate 7*d*. Meanwhile, the diaphragm 7*b* is formed into a plate shape. The piezoelectric elements D1 to Dn are attached and fixed to this diaphragm 7*b*. Since the diaphragm 7*b* is deformed by driving the piezoelectric elements D1 to Dn, volumes of the ink chambers 7*a* are increased or decreased in response to the deformation of the diaphragm 7*b*. In this way, the ink inside each of the ink chambers 7*a* is ejected from the nozzle 7*c* as droplets.

To be more precise, each of the piezoelectric elements D1 to Dn is contracted when a voltage is applied thereto and, therefore the contraction causes the diaphragm 7*b* to move upward and change the shape thereof. At this time, the pressure inside the ink chamber 7*a* becomes negative so that the ink is refilled from the ink buffer tank 11 into the ink chamber 7*a*. Thereafter, when the voltage applied to each of the piezoelectric elements D1 to Dn becomes equal to zero, the diaphragm 7*b* recovers the original condition. At this time, the ink chamber 7*a* is pressed inward so that the ink is ejected from the nozzle 7*c* as droplets.

Referring back to FIG. 1, the supporting mechanism 19 is fixed to the base plate 18. This supporting mechanism 19 includes z-axis direction movement mechanism for moving the droplet jetting head 7 in a z-axis direction, a Y-axis direction movement mechanism for moving the droplet jetting head 7 in the Y-axis direction, and a θ direction rotation mechanism for rotating the droplet jetting head 7 in a θ direction. In this way, the droplet jetting head 7 is movable in the z-axis direction and in the Y-axis direction and rotatable in the θ direction.

The head maintenance unit 10 is provided on the upper surface of the pedestal 5 at a location on a line extending in the moving direction of the inkjet head units 8 and away from the Y-axis direction guide plate 12. This head maintenance unit 10 cleans the droplet jetting heads 7 of the inkjet head units 8. Here, the head maintenance unit 10 cleans the droplet jetting heads 7 automatically in the state where each of the droplet jetting heads 7 of the inkjet head units 8 is stopped in a standby position facing the head maintenance unit 10.

The ink buffer tanks 11 are provided on the upper surface of the pedestal 5, each of which is configured to adjust a liquid level (meniscus) of the ink at a tip end of the nozzle by utilizing a water head difference (hydraulic head pressure) between a liquid level of the ink stored in the ink buffer tank and a nozzle level of the droplet jetting head 7. In this way, leakage or defective ejection of the ink is prevented.

Multiple ink tanks 20 for respectively containing ink fluids are detachably provided inside the ink supply box 4. These ink tanks 20 are connected to the respective droplet jetting heads 7 via the ink buffer tanks 11 by using supply pipes 21. Specifically, the droplet jetting heads 7 receive the ink supply from the ink tanks 20 via the ink buffer tanks 11. Here, various ink fluids can be used as the ink.

A control unit (a control device) 22 for controlling the units in the droplet jetting applicator 1 and a jetting error detection unit (a jetting error detector) 23 for detecting a jetting error of the droplet jetting heads 7 are disposed inside the pedestal 5.

Figure 3:
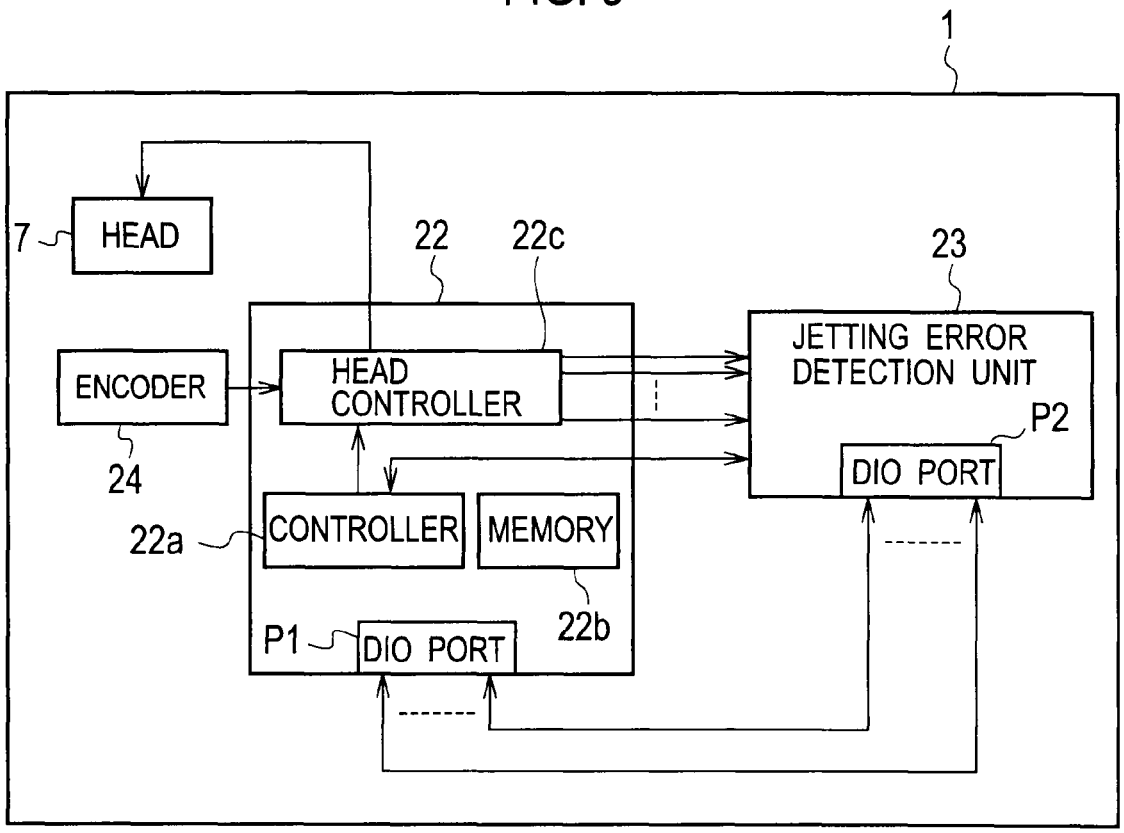
FIG. 3 is a block diagram showing schematic configurations of a control unit and a jetting error detector included in the droplet jetting applicator shown in FIG. 1.

As shown in FIG. 3, the control unit 22 includes a controller 22*a* such as a CPU for intensively controlling the units, a memory 22*b* for storing application information for jetting droplets, various programs, and the like, a head controller 22*c* for controlling the droplet jetting heads 7, and a DIO (digital I/O) port P1 for external connection. Meanwhile, the jetting error detection unit 23 includes a DIO (digital I/O) port P2 for external connection. An input unit (not shown) to be operated by an operator is connected to this jetting error detection unit 23. Here, the control unit 22 is connected to the jetting error detection unit 23 via a bus such as a CPCI bus. Moreover, the DIO ports P1 and P2 are connected to each other by using the same number of signal lines as the number of the nozzles (such as 64 nozzles).

The controller 22*a* controls movement of the Y-axis direction movement table 13, movement of the X-axis direction movement table 14, movement of the base plate 18, and so forth based on the application information and on the various programs. Moreover, the controller 22*a* also controls the head controller 22*c*. Here, the application information is the information on application by way of droplet jetting operations of the droplet jetting heads 7. This application information includes application pattern data (application pattern information), drive waveform data (drive voltage waveform information) for each droplet jetting head 7, set values of jetting positions (stop positions in the z-axis, Y-axis and θ directions) of each droplet jetting head 7, and the like. Here, the controller 22*a* transmits an application start signal for notifying the head controller 22*c* and the jetting error detection unit 23 of timing to start application.

The head controller 22*c* controls the droplet jetting heads 7 based on the application pattern data transmitted from the controller 22*c*. Here, encoders 24 are respectively connected to the movement mechanisms, for example, for moving the Y-axis direction movement table 13 and the X-axis direction movement table 14. These encoders 24 are connected to the control unit 22 and pulse signals (positional signals) therefrom are inputted to the head controller 22*c*. Therefore, an amount of movement of the substrate holding table 15 in the Y-axis direction is detected based on the pulse signal (the positional signal) from the encoder 24 connected to the movement mechanism for moving the Y-axis direction movement table 13. Similarly, an amount of movement of the substrate holding table 15 in the X-axis direction is detected based on the pulse signal (the positional signal) from the encoder 24 connected to the movement mechanism for moving the X-axis direction movement table 14. The head controller 22*c* controls droplet jetting operations of the droplet jetting heads 7 based on these pulse signals.

Figure 4:
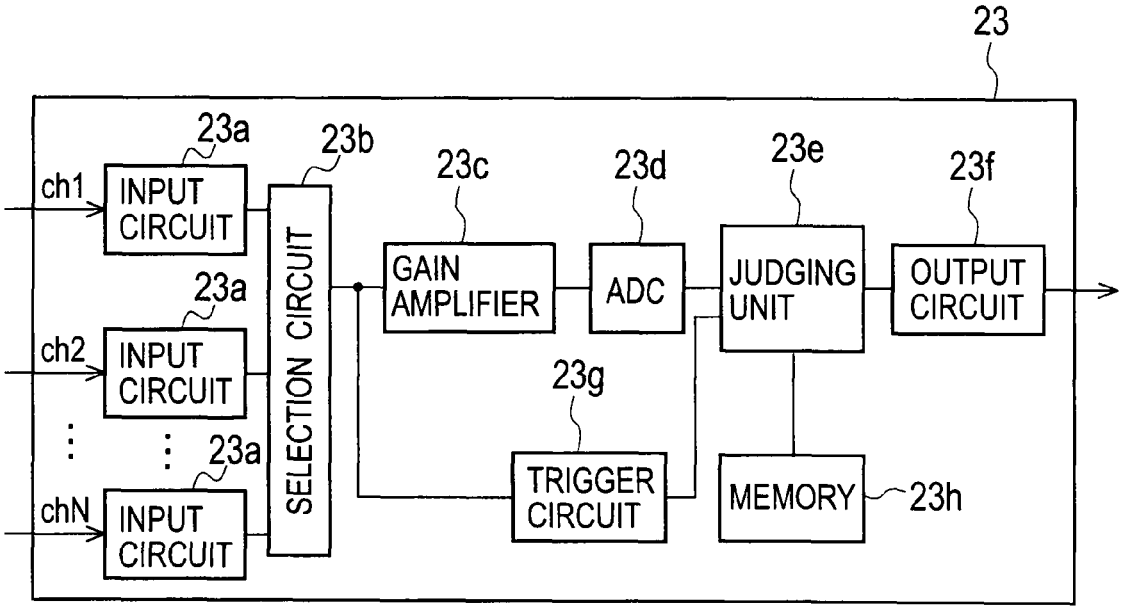
FIG. 4 is a block diagram showing a schematic configuration of the jetting error detector shown in FIG. 3.

As shown in FIG. 4, the jetting error detection unit 23 includes multiple input circuits 23*a* to which voltage values of the respective piezoelectric elements D1 to Dn (ch1 to chN) are inputted, a selection circuit 23*b* such as a channel selector for switching these input circuits 23*a*, a gain amplifier 23*c* used for amplification, an ADC (analog digital converter) 23*d* for A/D conversion, a judging unit 23*e* for judging jetting quality, an output circuit 23*f*, a trigger circuit 23*g*, a memory 23*h*, and the like. This memory 23*h* functions as a storage unit. When appropriate, a LPF (low pass filters) is located between the input circuit 23*a* and the trigger circuit 23*g* or in front of the ADC 23*d*, for example.

This jetting error detection unit 23 sequentially acquires, from the head controller 22*c*, voltage waveforms (such as 64 pieces of voltage waveforms equivalent to the number of the nozzles) of the respective piezoelectric elements D1 to Dn in jetting operation. The jetting error detection unit 23 causes the selection circuit 23*b* to switch the input circuits 23 to sequentially select one of the input circuits 23; acquires a voltage signal representing the voltage waveform from the selected input circuit 23*a*; causes the gain amplifier 23*c* to amplify the acquired voltage signal; causes the ADC 23*d* to digitalize the acquired signal; and then causes the judging unit 23*e* to perform processing such as a window function, a FFT (Fourier transform) computation, a jetting quality judgment (an OK/NG judgment). After the jetting quality judgment, an efficiency judgment signal as a jetting quality judgment result (an OK/NG judgment result) is outputted from the output circuit 23*f* to the control unit 22 through the DIO port P2. Here, the jetting error detection unit 23 has a trigger function using the trigger circuit 23*g* and is capable of optionally setting up data acquisition starting time from a rising edge of the voltage.

Here, the efficiency judgment signal is an ON/NG judgment signal indicating occurrence of a jetting error. This efficiency judgment signal needs to be transmitted immediately upon occurrence of the jetting error and high-speed processing is therefore required. In the jetting error detection unit 23 according to the embodiment of the present invention, the efficiency judgment signal is outputted about 230 μs after the rising edge of the voltage through the DIO port P2. This is a sufficiently high processing speed with respect to a maximum application frequency of 2 kHz (a jetting interval of 500 μs) assumed for manufacturing a display device.

Figure 5:
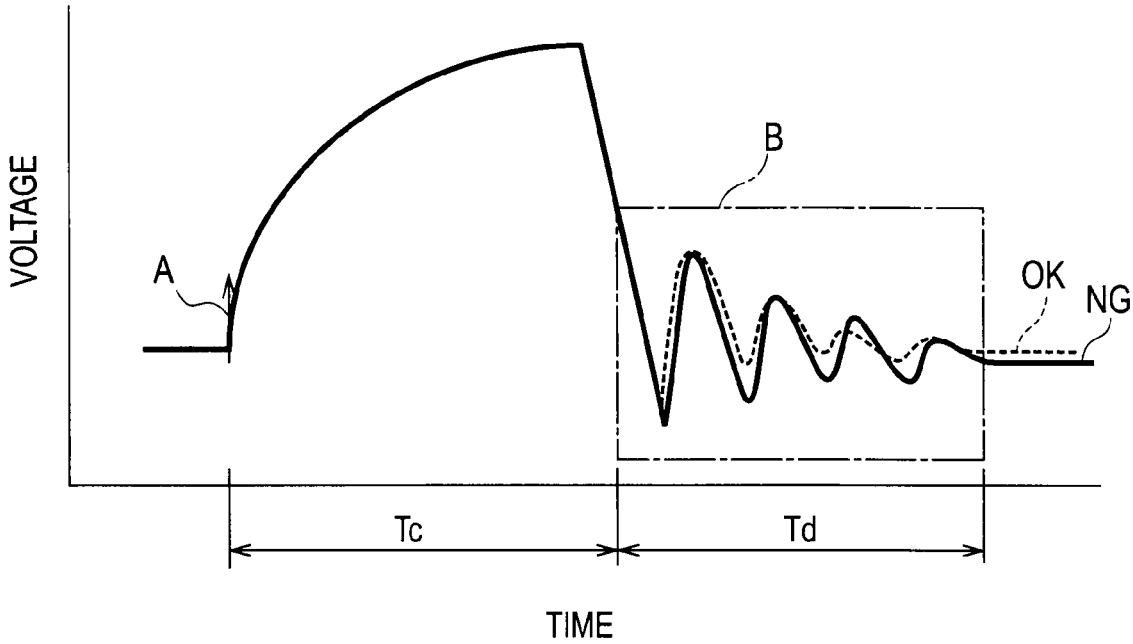
FIG. 5 is an explanatory view for explaining detection of a jetting error.
Figure 6:
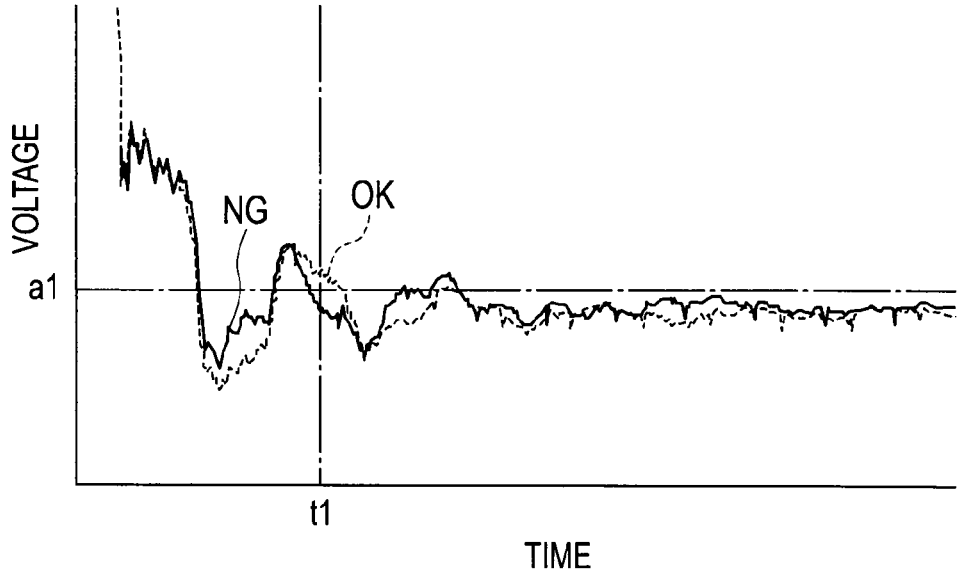
FIG. 6 is an explanatory view for explaining detection of a jetting error in light of a voltage.

To be more precise, as shown in FIG. 5, the above-described jetting error detection unit 23 detects a rising edge A of the voltage signal, and after elapse of data acquisition starting time Tc after the rising edge A, acquires the voltage signal just for a period of information acquisition time Td (i.e. the voltage signal in a region B in FIG. 5). FIG. 6 is an enlarged view showing this voltage signal. Thereafter, the jetting error detection unit 23 causes the judging unit 23*e* to perform various processing (algorithms) on the acquired voltage signal. For example, the judging unit 23*e* performs jetting error judgments (a first judgment and a second judgment) by using multiple algorithms, and then performs a final efficiency judgment by means of a logic operation using results thereof.

In the first judgment, in terms of the acquired voltage signal, the judging unit 23*e* compares a voltage value at an appropriate certain time point t1 with a threshold a1 as shown in FIG. 6. The judging unit 23*e* judges that there is no jetting error (an OK judgment) when the voltage value is greater than the threshold a1, or judges that there is a jetting error (an NG judgment) when the voltage value is equal to or below the threshold a1. Here, a waveform indicated by a dotted line in FIG. 6 is a waveform at the time of normal jetting (OK) while a waveform indicated by a solid line in FIG. 6 is a waveform at the time of an abnormal jetting (NG). As shown in FIG. 6, by defining the threshold a1 for the voltage level at the appropriate certain time point t1, it is possible to judge between normal jetting and abnormal jetting. This threshold a1 is a preset value which is stored in the memory 23*h*. Here, power source noise or cross talk generated in ejection from an adjacent nozzle is superposed on the actual voltage waveform. Accordingly, a filtering process for removing the noise, a masking process for a specific section, and the like are conducted by the judging unit 23*e*. Here, there are variations in the state of adhesion between the piezoelectric elements D1 to Dn and the diaphragm 7*b*, in piezoelectric materials, and in the application state of a damping material which is added for suppressing oscillation when necessary. Therefore, it is necessary to set up the threshold a1 for each nozzle 7*c*.

Figure 7:
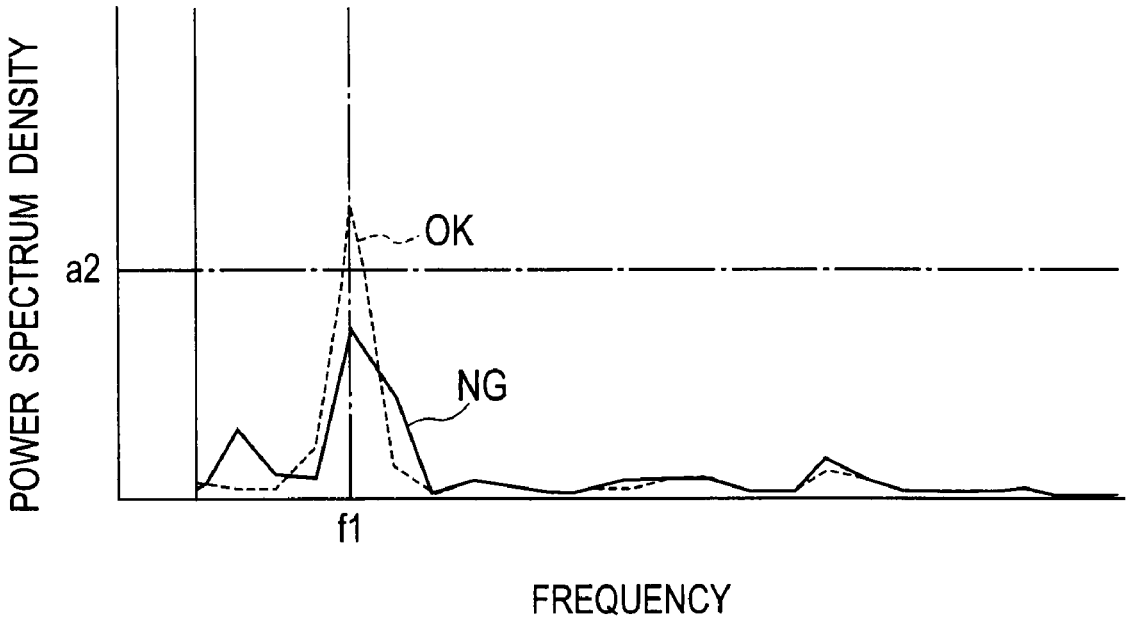
FIG. 7 is an explanatory view for explaining detection of a jetting error in light of power spectrum density.

In the second judgment, in terms of the acquired voltage signal, the judging unit 23*e* performs a Fourier transform on the voltage waveform of the voltage signal to obtain power spectrum density (using the Hanning Window, for example) as shown in FIG. 7, and then compares, with a threshold a2, a power spectrum density value at a certain frequency f1 near the natural vibration of a vibration system. The judging unit 23*e* judges that there is no jetting error (an OK judgment) when the power spectrum density value is greater than the threshold a2, or judges that there is a jetting error (an NG judgment) when the power spectrum density value is equal to or below the threshold a2. Here, a waveform indicated by a dotted line in FIG. 7 is a waveform at the time of normal jetting (OK), while a waveform indicated by a solid line in FIG. 7 is a waveform at the time of an abnormal jetting (NG). As shown in FIG. 7, by defining the threshold a2 for the power spectrum density level at the appropriate frequency f1, it is possible to judge between normal jetting and abnormal jetting. This threshold a2 is a preset value which is stored in the memory 23*h*.

In addition, upon receipt of the application start signal transmitted from the controller 22*a*, the judging unit 23*e* identifies an abnormally applied position (address of the NG judgment (dot number)) in the application pattern where the jetting error occurs while counting the number of voltage waveforms for each nozzle 7*c*, then generates address information indicating the position, and stores the address information in the memory 23*h*. For example, the abnormally applied position is identified by use of the nozzle 7*c* number having a jetting error and timing of the error occurrence. The address information stored in the memory 23*h* is transmitted to the control unit 22 upon a transmission request from the controller 22*a* of the control unit 22. Here, the judging unit 23*e* stores the voltage waveform in the memory 23*h* as appropriate. This judging unit 23*e* is configured with hardware such as a FPGA (field programmable gate array).

Next, a droplet application operation (a droplet application process) to be executed by the above-described droplet jetting applicator 1 will be described. The control unit 22*a* of the droplet jetting applicator 1 executes the droplet application process based on various programs. This droplet application process also includes a jetting error detection process, in which jetting anomalies occurring in the course of the application operation are detected for each of the nozzles 7*c*. Here, factors of such jetting anomalies include bubbles, dusts, disconnections of the piezoelectric elements D1 to Dn, contact failures between the piezoelectric elements D1 to Dn and the diaphragm 7*b*, and the like.

The controller 22*a* jets and applies the droplets on the substrate 2 on the substrate holding table 15, while controlling the droplet jetting heads 7 by using the head controller 22*c* on the basis of the application information. To be more precise, the controller 22*a* controls the movement mechanisms based on the application information (such as set values of jetting positions) to move the Y-axis direction movement table 13, the X-axis direction movement table 14, and the base plate 18, and to move the droplet jetting heads from standby positions to positions to face the substrate 2. In addition, the controller 22*a* controls the supporting mechanism 19 based on the application information to stop the droplet jetting heads 7 in predetermined positions. Landing pitches of the droplets are adjusted based on an angle with respect to the θ direction in these stop positions. Thereafter, the controller 22*a* controls the movement mechanisms based on the application information (such as the application pattern data or the drive waveform data) to move the Y-axis direction movement table 13, and causes the head controller 22*c* to control the droplet jetting heads 7 to jet the droplets from the droplet jetting heads 7 onto the substrate 2. The droplet jetting heads 7 jet ink as the droplets from the respective nozzles 7*c*, make those droplets land on the moving substrate 2, sequentially form dot arrays, and thereby perform application in the predetermined application pattern.

At this time, the jetting error detection unit 23 causes the selection circuit 23*b* to switch the input circuits 23*a* from one to another; sequentially acquires, from the head controller 22*c* of the control unit 22 through the input circuit 23*a*, voltage waveforms of the respective piezoelectric elements D1 to Dn in jetting operation; causes the gain amplifier 23*c* to amplify the acquired voltage signals being the voltage waveforms; causes the ACD 23*d* to digitalize the signals; and then causes the judging unit 23*e* to perform processing such as the window function, the FFT (Fourier transform) computation, and the jetting quality judgment (OK/NG judgment). In the jetting quality judgment, the NG judgment signal indicating the occurrence of the jetting error is generated when two NG judgments are made in the efficiency judgments based on the voltage level for each of the voltage waveforms of the piezoelectric elements D1 to Dn and based on the power spectrum density (the logic operation). The generated NG judgment signal is outputted from the output circuit 23*f* to the control unit 22 through the DIO port P2. Otherwise (the logic operation), the OK judgment signal indicating the absence of the jetting error is generated and the generated OK judgment signal is outputted from the output circuit 23*f* to the control unit 22 through the DIO port P2.

In addition, upon receipt of the application start signal transmitted from the controller 22*a*, the jetting error detection unit 23 identifies the abnormally applied position (the address of the NG judgment (the dot number)) in the application pattern where the jetting error occurs while counting the number of voltage waveforms for each nozzle 7*c*, then generates the address information indicating the position, and stores the address information in the memory 23*h*.

Subsequently, the controller 22*a* sequentially receives the efficiency judgment signals (the OK judgment signals or the NG judgment signals) from the jetting error detection unit 23 through the DIO port P1, and stops the droplet application operation when receiving the NG judgment signal (in the case of NG). Then, the controller 22*a* performs a restoring operation or a recovery operation. The restoring operation is either a cleaning operation (purging, wiping, or the like) by the head maintenance unit 10 or a replacing operation with other droplet jetting heads 7 that are standing by. The recovery operation is an operation to jet and apply the droplets again in the position where the jetting error (the dot position) occurs. In the case of performing this recovery operation, the controller 22*a* requests the jetting error detection unit 23 to transmit the address information. In response thereto, the jetting error detection unit 23 transmits the address information stored in the memory 23*h* to the controller 22*a*. Note that the recovering operation may be executed every receipt of the NG judgment signal or once after completion of applying the application pattern. Here, in the recovery operation, it is also possible to apply the droplets on an unapplied portion, which represents the position of occurrence of the jetting error, by using a droplet jetting head provided with fewer nozzles (for example, 1 to 5 nozzles), which is prepared separately from the droplet jetting heads 7.

In this way, the voltage values (voltage signals) of the piezoelectric elements D1 to Dn are sequentially acquired from the droplet jetting heads 7, then the jetting anomalies are sequentially judged for each of the nozzles 7*c* based on those voltage values, and the jetting quality judgment results (the OK/NG judgment results) are thus obtained. Accordingly, it is possible to detect a jetting error such as a jetting failure or a jetting amount shortage in the course of the application operations of application based on the application pattern data. Therefore, it is possible to temporarily stop manufacturing at the time of occurrence of a jetting error, and thereby to prevent continuous production of application defective items in a period from occurrence of the jetting error to discovery of the occurrence of the jetting error by inspection in a different process. As a consequence, a decrease of production yield attributable to the jetting error can be prevented.

Moreover, the abnormally applied position (the NG judgment address (the dot number)) in the application pattern where the jetting error occurs is stored in the memory 23*h* as the address information. Accordingly, the droplet jetting applicator 1 can perform the recovery operation based on the address information so that the substrate 2 including the jetting failure will not be treated as an application defective item. Hence a decrease of production yield attributable to the jetting error can be prevented. In addition, when the jetting error detection unit 23 detects the jetting error, the judgments are made by applying multiple algorithms (such as comparison between the voltage signal and the threshold a1 and comparison between the power spectrum density value obtained by the Fourier transform of the voltage signal and the threshold a2), and the final jetting quality judgment is made by performing a logic operation of those results. In this way, it is possible to detect the jetting error accurately, and thereby to perform jetting error detection at high accuracy.

As described above, according to the embodiment of the present invention, there are provided the multiple input circuits 23*a* to which the voltage values of the respective multiple piezoelectric elements D1 to Dn are inputted from the droplet jetting head 7; the selection circuit 23*b* configured to sequentially select one input circuit 23*a* out of those input circuits 23*a*; the judging unit 23*c* configured to judge, based on the voltage value inputted to the selected input circuit 23*a*, the jetting quality of the nozzle 7*c* for jetting the droplets by use of the piezoelectric elements D1 to Dn corresponding to the selected input circuit 23*a*; and the output circuit 23*f* configured to output the jetting quality judgment result of the nozzle 7*c*. The provision makes it possible to sequentially acquire the voltage values of the respective piezoelectric elements D1 to Dn and to obtain the jetting quality judgment results by sequentially judging the jetting error for each nozzle 7*c* on the basis of the acquired voltage values. Therefore, a jetting error can be detected in the course of the application operation to perform application based on the application pattern data, and thereby a decrease of the production yield attributable to the jetting error can be prevented.

Moreover, the abnormally applied position (the NG judgment address (the dot number)) of occurrence of the jetting error in the application pattern to be applied by the droplet jetting head 7 is obtained based on the jetting quality judgment result, and the abnormally applied position thus obtained is stored in the memory 23*h* as the address information. This enables the recovery operation based on this address information to eliminate the substrate 2 having the jetting failure as an application defective item, and thereby a decrease of the production yield attributable to the jetting error can be prevented. Here, it is also possible to carry out mapping (to form a map) of the obtained abnormally applied positions and to analyze a defect factor by importing the mapped data to CIM (computer integrated manufacturing).

In addition, by judging the jetting quality after comparing between the voltage value (the voltage signal) and the threshold all and between the power spectrum density value obtained by the Fourier transform of the voltage value (the voltage signal) and the threshold a2, the jetting error accurately can be detected to enable highly accurate jetting error detection. In particular, it is possible to accurately detect jetting anomalies caused by bubbles.

Other Embodiments

The present invention is not limited only to the above-described embodiment and various modifications are possible without departing from the scope of the invention.

For example, in the above-described embodiment, the jetting quality judgments based on the voltage level and the power spectrum density are applied to the algorithms for judging the jetting error. However, the invention is not limited only to these and may apply other jetting quality judging methods.

Meanwhile, the above-described embodiment employs the DIO ports P1 and P2 where high-speed processing is required. However, the invention is not limited only to this configuration. If the high-speed processing (real-time processing) is not critical, the jetting quality judgment results (the OK/NG judgment results) may be stored in the memory 23*h* to collectively transmit the accumulated jetting quality judgment results at any time (such as in response to a request from the controller 22*a*). For example, the accumulated jetting quality judgment results may be transmitted through a net work such as the Ethernet (registered trademark) by means of packet transmission. In this way, by sequentially storing the jetting quality judgment results for each of the multiple nozzles 7*c* in the memory 23*h* and collectively outputting the stored jetting quality judgment results, the need for providing the same number of DIO ports P1 and P2 as the number of nozzles is eliminated so that the device configuration can be simplified, if the high-speed processing is not critical. Moreover, it is also possible to reduce loads because control programs for watching I/O changes are not required.

Finally, although various numerical values are cited in the above-described embodiment, those numerical values are merely examples and the invention is not limited only to those values.

What is claimed is:

1. A jetting error detector comprising:

a plurality of input circuits configured to receive respective voltage values of a plurality of piezoelectric elements from a droplet jetting head configured to jet droplets through a plurality of nozzles by use of the plurality of piezoelectric elements;

a selection circuit configured to sequentially select one of the plurality of input circuits;

a judging unit configured to judge, based on the voltage value inputted to the selected input circuit, jetting quality of the nozzle for jetting the droplets by use of the piezoelectric element corresponding to the selected input circuit;

an output circuit configured to output a jetting quality judgment result of the nozzle;

a digital I/O port through which a judgment signal indicating the jetting quality judgment result is outputted from the output circuit; and a unit configured to obtain, based on the jetting quality judgment result, an abnormally applied position in which a jetting error occurs in an application pattern applied by the droplet jetting head, wherein when the judgment signal is an NG judgment signal, a droplet application operation is stopped and the droplet jetting head is controlled by a control unit which receives the judgment signal from the output circuit through the digital I/O port, based on the abnormally applied position, so as to jet and apply droplets again in the abnormally applied position, and the judging unit judges the jetting quality of the nozzle by comparing a threshold and the voltage value, and by comparing a threshold and a power spectrum density value obtained by a Fourier transform of the voltage value.

2. The jetting error detector according to claim 1, further comprising:

a first storage unit configured to store the obtained abnormally applied position.

3. The jetting error detector according to claim 1, further comprising:

a second storage unit configured to sequentially store the jetting quality judgment results for each of the plurality of nozzles, wherein the output circuit collectively outputs the plurality of stored jetting quality judgment results.

4. A droplet jetting applicator comprising:

a droplet jetting head configured to jet droplets through a plurality of nozzles by use of a plurality of piezoelectric elements;

a jetting error detector including:

a plurality of input circuits to which respective voltage values of the plurality of piezoelectric elements are inputted;

a selection circuit configured to sequentially select one input circuit out of the plurality of input circuits;

a judging unit configured to judge, based on the voltage value inputted to the selected input circuit, a jetting quality of the nozzle for jetting the droplets by use of the piezoelectric element corresponding to the selected input circuit;

an output circuit configured to output a jetting quality judgment result of the nozzle;

a digital I/O port through which a judgment signal indicating the jetting quality judgment result is outputted from the output circuit; and an obtaining unit configured to obtain, based on the jetting quality judgment result, an abnormally applied position in which a jetting error occurs in an application pattern applied by the droplet jetting head; and a control unit configured to stop a droplet application operation and control, based on the abnormally applied position, the droplet jetting head so as to jet and apply droplets again in the abnormally applied position when the control unit receives the judgment signal from the output circuit through the digital I/O port and the judgment signal is an NG judgment signal, wherein the judging unit judges the jetting quality of the nozzle by comparing a threshold and the voltage value, and by comparing a threshold and a power spectrum density value obtained by a Fourier transform of the voltage value.

5. The droplet jetting applicator according to claim 4, wherein the jetting error detector further comprises:

a first storage unit configured to store the obtained abnormally applied position.

6. The droplet jetting applicator according to claim 4, wherein the jetting error detector further comprises a second storage unit configured to sequentially store the jetting quality judgment results for each of the plurality of nozzles, and the output circuit collectively outputs the plurality of stored jetting quality judgment results.

7. A display device manufacturing method, wherein droplets are jetted and applied onto an application target by using the droplet jetting applicator according to claim 4.

8. A jetting error detector comprising:

a plurality of input circuits configured to receive respective voltage values of a plurality of piezoelectric elements from a droplet jetting head configured to jet droplets through a plurality of nozzles by use of the plurality of piezoelectric elements;

a selection circuit configured to sequentially select one of the plurality of input circuits;

a judging unit configured to judge, based on the voltage value inputted to the selected input circuit, a jetting quality of the nozzle for jetting the droplets by use of the piezoelectric element corresponding to the selected input circuit;

an output circuit configured to output a jetting quality judgment result of the nozzle; and a digital I/O port through which a judgment signal indicating the jetting quality judgment result is outputted from the output circuit, wherein the judging unit judges the jetting quality of the nozzle by comparing a threshold and the voltage value, and by comparing a threshold and a power spectrum density value obtained by a Fourier transform of the voltage value.

9. A droplet jetting applicator comprising:

a droplet jetting head configured to jet droplets through a plurality of nozzles by use of a plurality of piezoelectric elements; and a jetting error detector including a plurality of input circuits to which respective voltage values of the plurality of piezoelectric elements are inputted, a selection circuit configured to sequentially select one input circuit out of the plurality of input circuits, a judging unit configured to judge, based on the voltage value inputted to the selected input circuit, a jetting quality of the nozzle for jetting the droplets by use of the piezoelectric element corresponding to the selected input circuit, an output circuit configured to output a jetting quality judgment result of the nozzle, and a digital I/O port through which a judgment signal indicating the jetting quality judgment result is outputted from the output circuit, wherein the judging unit judges the jetting quality of the nozzle by comparing a threshold and the voltage value, and by comparing a threshold and a power spectrum density value obtained by a Fourier transform of the voltage value.

* * * * *